United States Patent [19]

Bascou

[11] Patent Number: 4,597,598

[45] Date of Patent: Jul. 1, 1986

[54] DEVICE FOR ELECTRICAL OPENING AND CLOSING OF A VEHICLE LID EQUIPPED WITH A LOCK OF THE COCKING TYPE

[75] Inventor: Jacques Bascou, Bazemont, France

[73] Assignee: Regie Nationale des Usines Renault, Boulogne-Billancourt, France

[21] Appl. No.: 674,644

[22] Filed: Nov. 26, 1984

[30] Foreign Application Priority Data

Nov. 25, 1983 [FR] France ..... 83 18819

[51] Int. Cl.[4] ..... E05C 5/02

[52] U.S. Cl. ..... 292/68; 70/241; 292/201; 292/216; 292/DIG. 14; 292/DIG. 43

[58] Field of Search ..... 292/201, 64, 216, 68, 292/207, DIG. 43, DIG. 14, 341.16; 70/241

[56] References Cited

U.S. PATENT DOCUMENTS

| | | | |
|---|---|---|---|
| 2,741,503 | 10/1957 | Thompson, III | 292/201 X |
| 2,896,990 | 7/1959 | Garvey et al. | 292/201 X |
| 2,898,138 | 8/1959 | Van Noord | 292/201 X |
| 2,903,288 | 9/1959 | Joachim et al. | 292/341.16 |
| 2,916,319 | 12/1959 | Du Bois . | |
| 2,943,880 | 7/1960 | Joachim . | |
| 2,950,138 | 8/1960 | Meyer et al. | 292/DIG. 43 X |
| 2,994,550 | 8/1961 | White | 292/DIG. 43 X |
| 3,081,078 | 3/1983 | Lohr | 292/DIG. 43 X |
| 3,378,291 | 4/1968 | Brian . | |
| 3,566,703 | 3/1971 | Van Noord | 292/201 X |

FOREIGN PATENT DOCUMENTS

| | | | |
|---|---|---|---|
| 0143705 | 6/1985 | European Pat. Off. | 70/276 |
| 2498238 | 7/1982 | France . | |
| 2501766 | 9/1982 | France . | |

*Primary Examiner*—Robert L. Wolfe
*Assistant Examiner*—Lloyd A. Gall
*Attorney, Agent, or Firm*—Oblon, Fisher, Spivak, McClelland & Maier

[57] ABSTRACT

A device for electrical opening and closing of a motor lid, such as a trunk lid, equipped with a lock of the cocking type includes a case in which a latch and a locking lever are mounted to pivot. The locking of the lock is done mechanically during the closing of the lid and is extended by a complete electrical closing of the lid as a result of a gearmotor which assures the axial sliding of the case inside a sleeve. The partial electrical opening is obtained by rotation in a reverse direction of the gearmotor, which causes the axial exiting of the case outside of the sleeve together with the automatic unlocking of the cocking lock.

14 Claims, 11 Drawing Figures

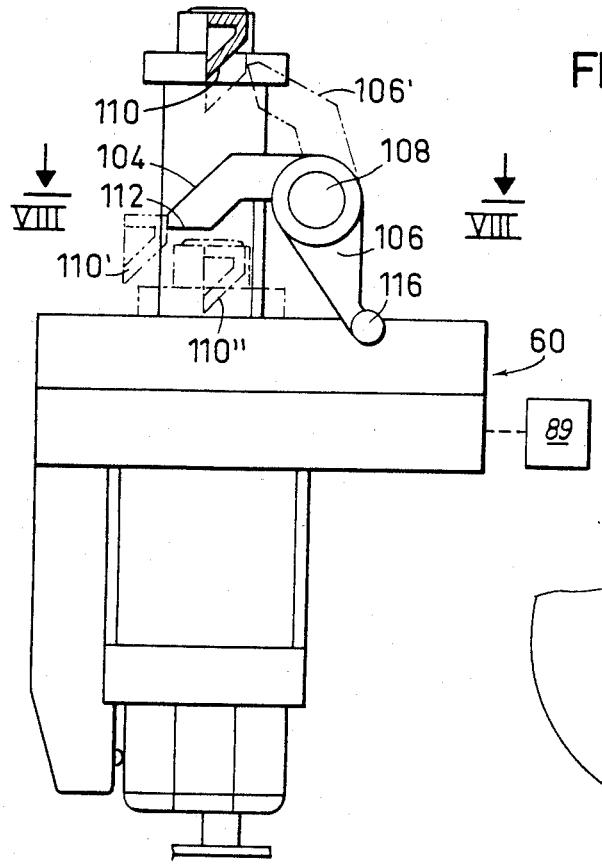
FIG.6
FIG.8
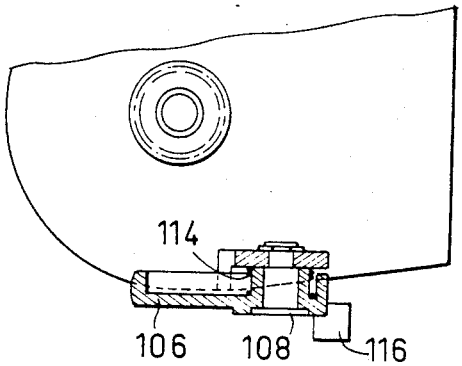
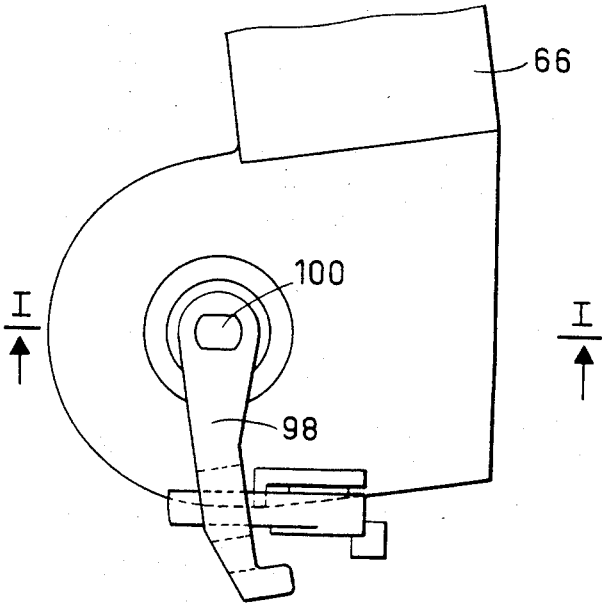
FIG.7

DEVICE FOR ELECTRICAL OPENING AND CLOSING OF A VEHICLE LID EQUIPPED WITH A LOCK OF THE COCKING TYPE

BACKGROUND OF THE INVENTION

1. Field of the Invention

This invention has as its object a device for electrical opening and closing of a motor vehicle lid equipped with a lock of the cocking type, such as a hood or a trunk lid.

2. Description of the Prior Art

The operations for opening and closing the lid generally require manual manipulations. It is therefore desirable to avoid as much as possible the manual operations and to replace them with controlled mechanisms, and to do this without resorting to costly or complicated solutions.

For this purpose, a device has already been proposed in French Pat. No. 2,501,766 that makes it possible to assure automatic locking and unlocking of a lid as a result of an easy approach and a smooth presentation of this lid up to the first striker notch of the lock without having to apply significant force on the lid. In this device, the locking itself of the lock is assured electrically and the unlocking by means of a gear motor which drives successively, in the direction for opening and in the reverse direction for closing, the locking lever of the cocking lock in response to electric current pulses.

Although it works quite well, this device does not enable the user to easily see the opening or closing and the actual locking of the lid of the motor vehicle.

SUMMARY OF THE INVENTION

The present invention has as its object the provision of a device for partial electrical opening and electrical closing of a motor vehicle lid over a distance sufficient for the user of the vehicle to see the resulting movement of the trunk lid.

For this purpose, the invention proposes a device for electrical opening and closing of a motor vehicle lid equipped with a lock of the cocking type having a case in which are mounted to pivot a latch in the shape of a hook which holds a striker in locked position and a lever for locking the latch in locked position, the pivoting shaft of the lever being perpendicular to the pivoting shaft of the latch and extending outside of the case via a control shank of the lock which comes out at the upper part of the lock. The case of the lock is located in a guide sleeve, attached to the lid, inside of which it can move axially under the action of a gearmotor to cause the complete electrical closing of the lid in response to an electric pulse delivered by a first electric contact triggered by the locking latch when this latter goes beyond its angular position for locking the lock in the direction corresponding to the locking of this latter.

As a result, the user causes the complete electrical closing of the lid of the motor vehicle after having caused the locking of the cocking lock, the movement of the lid being obtained as a result of the electrically controlled axial movement of the case of the lock in relation to the sleeve, an axial movement which has the effect of also moving the latch of the lock in relation to the lid, the latch being mounted to pivot in the mobile case.

The locking of the cocking lock is here assured manually by the user of the vehicle in a conventional way, the locking forces being minimized as a result of a particular structure of the lock itself.

According to another feature of the invention, the case can move axially inside the sleeve in a second direction, opposite the first direction to cause the partial electrical opening of the lid in response to an electric pulse delivered to the gearmotor from a second electric contact activated by the user of the vehicle.

According to another feature of the invention, the device includes mechanical means that cause the automatic unlocking of the lock during the partial electrical opening of the lid performed by the gearmotor.

As a result of these features, it is easily understood that the automatic electrical opening of the trunk is accomplished by the reverse rotation of the gearmotor, on an electric pulse for opening provided remotely, either from a second electric contact inside the body of the vehicle, or from a second electric contact which is outside activated, for example, by a trunk key or by a push button.

The action of the gearmotor in reverse direction causes the case to come outside of the guide sleeve over a distance equal to that corresponding to the closing of the lid, the automatic unlocking of the lock being assured at the end of the travel for partial opening of the trunk.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 6 is an exterior view in elevation of the device shown in FIG. 1;

FIG. 7, is a top view of the device shown in FIG. 6;

FIG. 8 is a view in partial section along line 8—8 of FIG. 6;

DETAILED DESCRIPTION OF THE PREFERRED EMBODIMENTS

Figure 2:
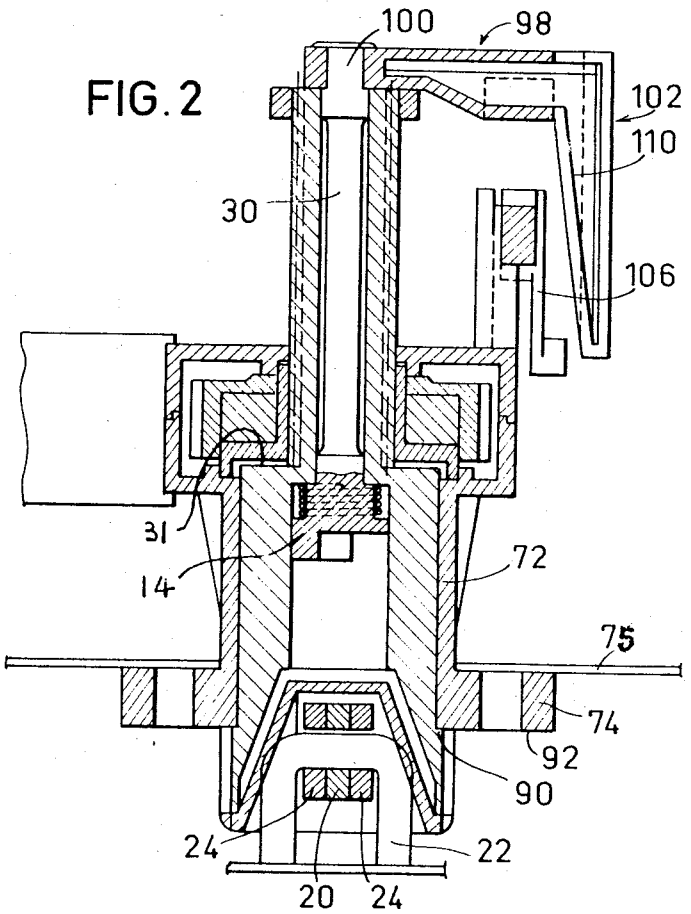
FIG. 2 is a view in section along line 2—2 of FIG. 1.

Shown in the figures is a lock of the cocking type, adapted to be installed on a motor vehicle for which it assures the closing of a lid, such as the trunk lid. The lock has a case 10 in which are pivotally mounted a latch in the shape of a hook 12 and a locking lever 14. Latch 12 is mounted to pivot in case 10 around a shaft 16 whose ends are received in a bore 18 of case 10 of the lock.

Latch 12 is equipped at its lower part with a hook 20 of standard shape which is able to hold the upper portion of a U-shaped striker 22. Hook-shaped part 20 of latch 12 is reinforced with two side plates 24 juxtaposed with the main part constituting the body of latch 12.

Locking lever 14 is located entirely inside case 10 of the lock. Locking lever 14 includes a cylindrical body 26 which is mounted so as to pivot in a corresponding cylindrical portion 28 in an upper part 31 of case 10. Cylindrical body 26, which defines the axis of rotation of locking lever 14 itself, is extended at its upper part by a control shank 30 which extends through and outside upper part 31 of the case 10 of the lock. Cylindrical body 26 of locking lever 14 is equipped at its lower part with a locking stud 32 which, as will be explained below, works with free end 34 of the upper part of latch 12 to assure its being held in a closed position.

Figure 1:
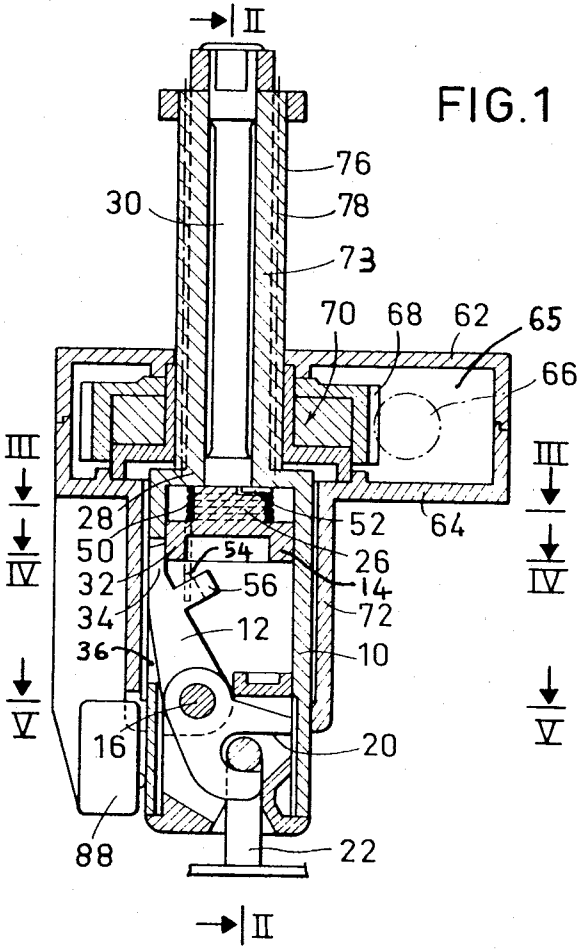
FIG. 1 is a view in axial section of the device of this invention, the lid being in a closed and locked position along line 1—1 of FIG. 7.
Figure 4:
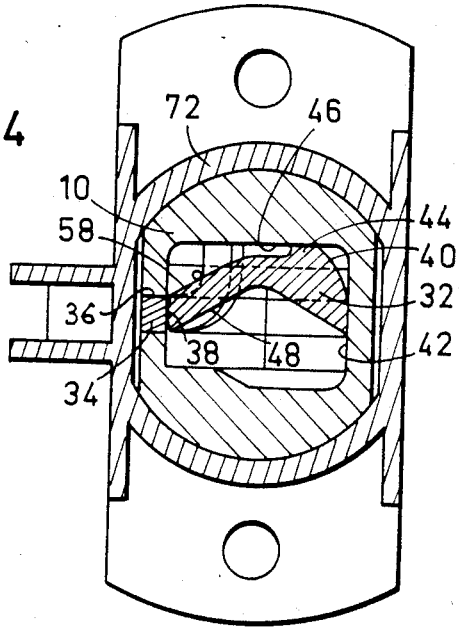
FIG. 4 is a view in section along line 4—4 of FIG. 1.

Case 10 is provided with an elongated exit slot 36 which extends to the outside of case 10 and inside of which, as can be seen in FIGS. 1 and 4, the free end 34 of the latch is held by locking stud 32 when the lock is in the locked position. As will be explained below, exit slot 36 constitutes a window of case 10 through which free end 34 can exit to activate an electric contact.

In the locked position, and as can be seen in FIG. 4, free end 34 of latch 12 rests against free edge 38 of locking stud 32. This free edge 38 has a slightly convex outer surface so as to facilitate its cooperation with end 34 of latch 12 and its pivoting inside case 10. In the same way, the opposite end of locking stud 32 is provided with a convex surface 40 which cooperates with inner wall 42 of case 10. Locking stud 32 is provided with a side stop 44 unitary with stud 32, and which coopertes with a stop surface 46 formed adjacent inner wall 42 of the case to define the locked position of locking stud 32, toward which this latter is elastically returned.

Locking stud 32 is provided with a first ramp 48 which works with free end 34 of latch 12 to cause the rotation of the locking stud and the retraction of this latter when locking of the lock is brought about so as to make it possible for end 34 to penetrate into the slot or window 36.

Like all locks of the cocking type, the lock shown in the Figures is equipped with elastic means which keep locking lever 14 and latch 12 in a cocked position. For this purpose, the locking lever is equipped with a return spring 50 which is a coil spring wound around cylindrical body 26 and having one end 52 fastened inside cylindrical body 26. End 52 which is slipped into a slot of cylindrical body 26 is thus driven in rotation with body 26. The other end 54 of spring 50 is rotatably fixed around the axis of rotation of locking lever 14. End 54 engages a lug 56 made in the vicinity of free end 34 of latch 12 to also assure the return spring function of the latch 12.

Figure 3:
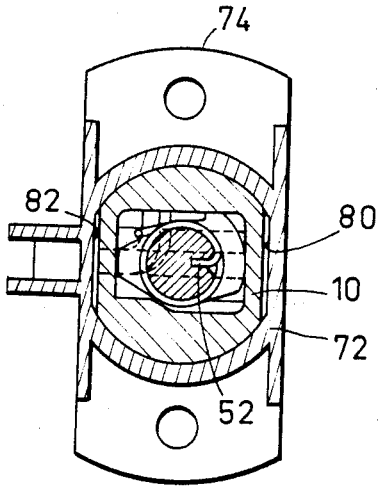
FIG. 3 is a view in section along line 3—3 of FIG. 1.
Figure 5:
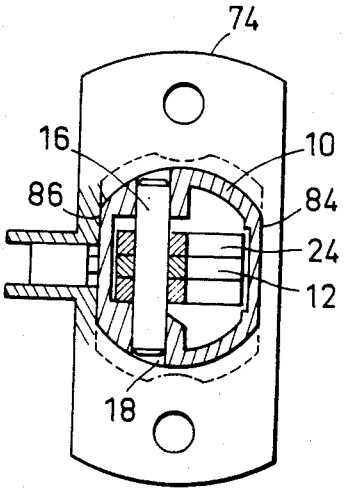
FIG. 5 is a view in section along line 5—5 of FIG. 1.

The mechanical operation of the cocking lock shown in the Figures will now be described. When the lock is in its locked position, shown in FIGS. 1 to 5, and when it is desired to open it, it suffices to begin, manually or by any other means, a rotation of control shank 30 of locking lever 14. This clockwise rotation (looking at FIGS. 3 to 5) has the effect of causing, in opposition to the elastic force exerted by return spring 50, a rotation of free edge 38 of locking stud 32 until this latter is completely retracted from in front of end 34 of latch 12. When this rotation is performed, under the action of the elastic return exerted by spring 50, latch 12 pivots in a clockwise rotation (looking at FIG. 1) around its shaft 16, causing end 34 of latch 12 to come out of slot 36 until the latch occupies the position shown in FIGS. 9 and 10, in which striker 22 is free to leave hook 20.

In this unlocked position, free end 34 of latch 12 is located inside the receptable delimited by ramp 48 of locking stud 32. As soon as the force applied on control shank 30 is stopped, and under the action of elastic return exerted by spring 50, the locking stud comes back to occupy its cocked position in which stop 44 rests on stop surface 46 and free edge 38 of the stud is again opposite slot 36 made in case 10.

Figure 9:
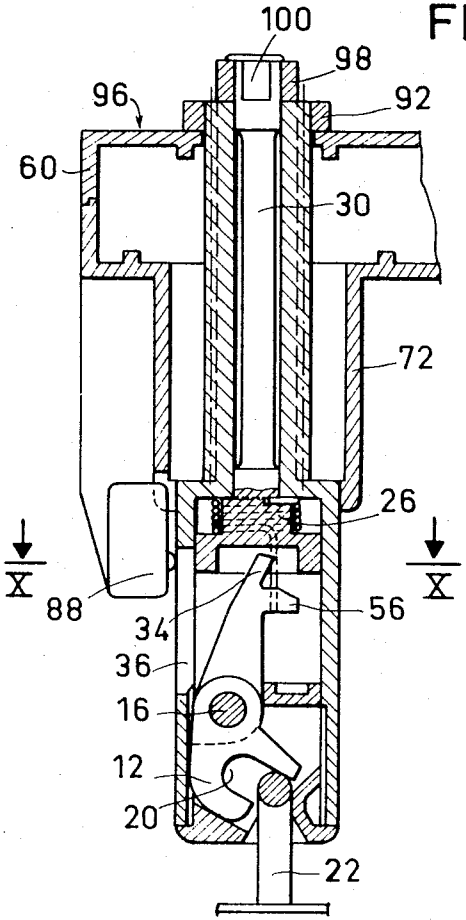
FIG. 9 is a view in axial section similar to that of FIG. 1 in which the lid is in a partially open position, the lock being unlocked.

When it is desired to lock the lock, the user, after having brought the lid of the vehicle into a position corresponding to the relative position of striker 22 in relation to case 10 shown in FIG. 9, exerts a downward force on the lid in an approximately vertical direction (looking at FIG. 9). This force has the effect of causing a rotation of the latch around its shaft 16 in a counterclockwise direction.

This rotation causes a movement of free end 34 of latch 12 to the left (looking at FIG. 10), until this end 34 rests against the first ramp 48 of locking stud 32. The vertical force applied to the lid then has the effect, as a result of cooperation between free end 34 of latch 12 and ramp 48, of causing a rotation of the locking stud and therefore of the locking lever 14 unit in a clockwise direction (looking at FIG. 10). This rotation results in totally retracting locking stud 32 to allow the penetration of free end 34 of latch 12 into slot 36 provided for this purpose in case 10. This rotation of locking stud 32 and of latch 12 is done in opposition to the elastic return force exerted on the two elements by spring 50. As soon as free end 34 of latch 12 has entirely penetrated into slot 36, under the action of return spring 50, the locking stud again occupies its locking position shown in FIG. 4, a position in which the latch is locked in a closed position. If the user continues to exert downward vertical force on the lid, this force will have the effect of causing an additional rotation of latch 12 around its shaft 16 in a counterclockwise direction (looking at FIG. 11). This additional rotation will have the effect of causing free end 34 of latch 12 to extend to the outside of case 10 through the window or slot 36 provided for this purpose to trigger an electric contact whose operation will be described below.

Having described the cocking lock itself and its mechanical operation, the device for electrical opening and closing made according to this invention will now be described in greater detail.

The device comprises essentially a gearmotor 60 having an upper flange 62 and a lower flange 64. Gearmotor 60 houses an electric motor located in portion 65 of the gearmotor whose driving pinion 66 (shown in outline in FIG. 1) drives outer annular gear 68 of a driving nut 70 which is axially fixed, and guided in rotation, in the case defined by the upper and lower flanges 62 and 64.

Lower flange 64 is extended at its lower part by an approximately cylindrical guide sleeve 72 which is provided at its lower end with a fastening flange 74, making it possible to assure the mounting and fastening of the whole device on vehicle lid 75.

As can be seen in the Figures, case 10 of the lock is in large part located in guide sleeve 72 inside of which it can move axially in a vertical or first direction under the action of gearmotor 60. Axial movements of case 10 are obtained as a result of the conversion of the rotation movement of driving nut 70 into such axial movement of case 10. For this purpose, the upper 31 of case 10 is further extended by a cylindrical portion 73 which exits the upper part of upper flange 62.

Outer surface 76 of cylindrical upper part 73 of case 10 of the lock is provided with a thread 78 which cooperates with a corresponding internal thread of driving nut 70 of the gearmotor.

To transform the successive alternate direction rotations of driving nut 70 into an axial translation movement of the upper part 31 of case 10 and therefore of the case itself, sleeve 72 is equipped at its inner periphery with two flat surfaces 80 and 82 which cooperate with two corresponding flat surfaces 84 and 86 made on the outer wall of case 10 of the lock to prevent any rotation of case 10 in relation to the sleeve. Thus, it is easily understood that any rotation of nut 70 is transformed into an axial movement of case 10 of the lock parallel to the axis of rotation of locking lever 14 which is extended by control shank 30.

Figure 10:
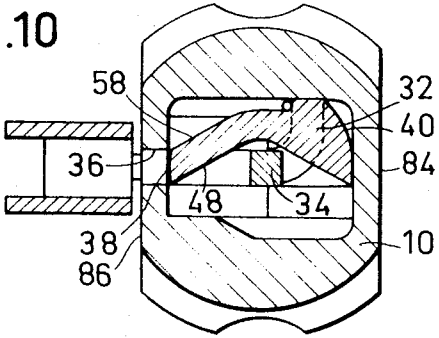
FIG. 10 is a view in section along line 10—10 of FIG. 9.
Figure 11:
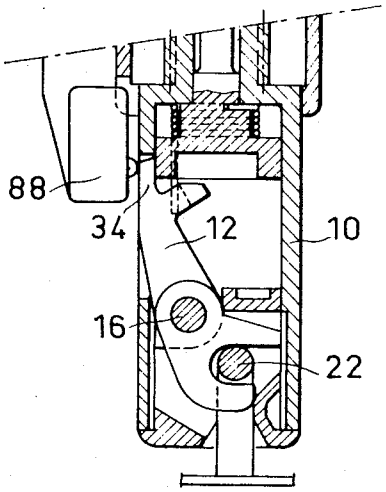
FIG. 11 is a view in axial section of the lower part of the device, the lid being in a partially open position, the lock being already locked.

A first electric contact 88 is located in the vicinity of the lower end of guide sleeve 72 and facing window 36 made in case 10 when case 10 occupies an axial position in relation to the sleeve corresponding to the partial opening of the lid, as shown in FIGS. 10 and 11. In this position, and particularly as can be seen in FIG. 11, free end 34 of latch 12 can trigger electric contact 88 when the latch goes beyond the angular position for locking the lock in the direction corresponding to the locking of this latter, i.e., in a counterclockwise direction, looking at FIG. 11, and this taking place under the action of an additional downward force in a vertical direction exerted by the user on the lid tending to cause the additional rotation of latch 12.

According to the invention, and as a result of a suitable electric circuit (not shown), the triggering of the first electric contact 88 by free end 34 of locking latch 12 has the effect of causing the complete electrical closing of the lid in response to the resulting electric pulse delivered to gearmotor 60 by contact 88. The resulting actuation of the gearmotor 60 causes an axial movement of case 10 in sleeve 72 in a first upward sense of the vertical direction looking at the Figures, until case 10 occupies the position shown in FIG. 1. In this position, the lock is locked and case 10 occupies a maximum height position in sleeve 72. This maximum height position is defined by the cooperation of a shoulder 90 made at the lower part of case 10 of the lock with the lower face of fastening flange 74 of the sleeve 72.

According to the invention, case 10 can move axially inside sleeve 72 in a second sense of the vertical direction, opposite the first sense, i.e., vertically downward, to cause the partial electrical opening of the lid in response to an electric pulse delivered to the gearmotor from a second electric contact 89 activated by the user of the vehicle. This partial opening phase is obtained by the rotation in a reverse direction of the gearmotor in response to the electric impulse for opening provided remotely either from a second electric contact located inside the body of the vehicle, or from an outside contact activated, for example, by a trunk key or by a push button.

The working of the gearmotor in reverse direction, i.e., in the direction of opening, will cause case 10 to descend vertically in guide sleeve 72 to bring it into a maximum opening position shown in FIGS. 10 and 11; this maximum opening position is defined by the cooperation of stop 92 screwed in at the upper end of threaded upper part 73 of case 1 with upper face 96 of upper flange 62 of gearmotor 60.

According to the invention, the device also includes mechanical means that make it possible to cause the automatic unlocking of the cocking lock during the partial electrical opening of the lid performed by gearmotor 60.

These mechanical means consist of a rotating control lever 98 on the shaft of the locking lever of the lock. Rotating control lever 98 is mounted at upper free end 100 of control shank 30 of locking lever 14.

To cause the rotation of control lever 98 during the partial electrical opening of the lid performed by the gearmotor, it is necessary to transform the vertical linear movement of upper part 73 of case 10 into a rotating movement. For this purpose, a perpendicular extension 102 of rotating control lever 98 cooperates with a ramp 104 made on a catch 106. Catch 106 is mounted to pivot on upper flange 62 of gearmotor 60 by a horizontal shaft 108. To facilitate this cooperation, control lever 98 is equipped with a corresponding ramp 110 shown in FIG. 6. Catch 106 is kept in this normal operating position, shown in continuous lines in FIG. 6, by a rotating return spring 114.

Catch 106 must act to control the rotation lever 14 by control lever 98 only when case 10 moves vertically downward, i.e., during the partial electrical opening of the lid. For this purpose, the catch is retractable when the case moves vertically upward, i.e., it pivots around its shaft 108 in opposition to the elastic return force exerted by spring 114. Return spring 114 of catch 106 must be selected so that its elastic return torque is clearly less than that of elastic return spring 50 of locking stud 32 so as not to cause the rotation of lever 98 when it comes in contact with catch 106.

Ramp 110 of lever 98 and pin 116 of catch 106 are also used to disengage the system to permit one to unlock the lock in case of electrical failure regardless of the axial position of case 10 in relation to sleeve 72.

The operation of the device for electrical closing and partial electrical opening of the lid will now be described.

When the user desires to cause the closing of the lid, he exerts on this lid a downward vertical force until striker 22 comes in contact with hook 20 as is shown in FIG. 9. By continuing to exert a vertical force on the lid, the user causes the mechanical locking of the lock as has been explained above, until latch 12 occupies the position shown in FIG. 11. In this position, the lock is mechanically locked, but the lid is not completely closed.

To cause the complete electrical closing of the lid, the user need only exert a slight additional force on the lid so that free end 34 of latch 12 triggers the first electric contact 88. As soon as this triggering is obtained, an electric pulse is transmitted to the gearmotor which drives driving nut 70 in rotation in the direction of closing. This rotation in the direction of closing has the effect of causing the axial upward movement of case 10 of the lock so as to move the inside of sleeve 72 of lower flange 64 until stop 90 rests on lower face 92 of flange 74.

In this position of complete closing, detection means (not shown), sensitive to the torque exerted on driving nut 70, causes gearmotor 60 to stop.

The successive operations which have just been mentioned to obtain the locking of the lock and the complete electrical closing of the lid are performed in actuality in a single continuous vertical movement by the user on the lid with a very moderate force, the particular structure of the mechanical lock itself and the sensitivity of the first electric contact 88 making it possible to obtain a perfect sequence of the operations.

When the user desires the cause the opening of the lid, he acts by means of a second electric contact to provide an electric pulse to gearmotor 60. In response to this pulse, gearmotor 60 causes the rotation of driving nut 70 in the reverse direction corresponding to the opening of the lid. This rotation has the effect of causing the vertical axial downward movement of case 10 in guide sleeve 72. This axial movement continues until stop 92 comes in contact with upper face 96 of upper flange 62 of gearmotor 60. This maximum opening position, which is obtained electrically, is shown in FIG. 9.

During the descending movement of case 10 of the lock, and as has been explained above, the cooperation between control lever 98 and catch 106 causes the rotation of the control shank of locking lever 14 in a clockwise direction (looking at FIG. 4). This rotation results in causing the unlocking of the mechanical lock. Ramps 110 and 112 are formed so that the unlocking of the lock occurs only at the end of axial travel of case 10 in relation to guide sleeve 72.

The positions successively occupied by ramp 110 formed on control lever 98 during the vertical axial downward movement of the case of the lock are shown by dotted lines in FIG. 6 with the reference numerals 110' and 110''. Position 110' corresponds to the maximum angular rotation of locking lever 14 around its shaft 26 as a result of which free end 34 of latch 12 can leave slot 36 to occupy its unlocked position shown in FIG. 9. Position 110'' corresponds to the angular rest position toward which control lever 98 is returned elastically by spring 50.

The angular position occupied by catch 106 when this catch is retracted in opposition to the elastic return force exerted by spring 114 during the rise of control lever 98 corresponding to the complete electrical closing of the hood is shown in dotted lines in FIG. 9 with the reference numeral 106'.

By way of variant, a short circuit (not shown) can be mounted to neutralize the electrical function of complete closing of the lid to allow the user to have the possibility of locking the lid in the partially open position, which may be desirable for various reasons such as, for example, the presence of a domestic pet in the trunk equipped with the lid.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the united states is:

1. A device for locking and electrically opening and closing a motor vehicle lid, said device comprising:

a guide sleeve fixed relative to said lid;

a lock case moveable in said guide sleeve in a first direction;

a gearmotor fixed relative to said lid and including means for moving said lock case in two opposite senses of said first direction between a partial opening position and a closed position;

a latch pivotally mounted in said lock case for pivoting about an axis perpendicular to said first direction along an arc including a locked position and an unlocked position, said latch having a hook portion engagable with a striker fixed to said lid when said latch is pivoted into said locked position;

a locking lever having a pivot shaft pivotable about a pivot axis extending in said first direction, said pivot shaft having a control portion extending out of said lock case, said locking lever including means for locking said latch in said locked position; and a first electric contact positioned such that when said case is in said partial opening position, said first electric contact is engaged and triggered by said latch when said latch moves from said locked position and in a direction away from said unlocked position, said gearmotor being operatively connected to said first electric contact for moving said case to said closed position.

2. The device of claim 1 including a second manually operable electric contact operatively connected to said gearmotor for moving said case to said partial opening position.

3. The device of claim 2 including mechanical means responsive to movement of said case from said closed position to said partial opening position for releasing said locking of said latch in said locked position by said locking lever.

4. The device of claim 3 wherein said mechanical means includes:

a control lever fixed to said control portion of said locking lever; and a ramp cooperating with said control lever during said movement of said case from said closed position to said partial opening position.

5. The device of claim 4 wherein said mechanical means further includes a catch pivotally mounted relative to said lid, said ramp forming a portion of said catch, said catch including means for preventing engagement of said ramp and control lever during movement of said case from said partial opening position to said closed position.

6. The device of claim 1 wherein said guide sleeve comprises an extension of a lower flange of said gearmotor, and wherein said means for moving said lock case in opposite senses comprises:

a thread on an outer surface of a portion of said casing; and a driving nut rotatably driven by said gearmotor and engaging said thread.

7. The device of claim 1 including a slot in said lock case through which a portion of said latch extends out of said case when said latch moves from said locked position and in a direction away from said unlocked position, wherein said first electric contact is in facing opposition to said slot when said case is in said partial opening position.

8. The device of claim 1 wherein said means of said locking lever for locking said latch in said locked position comprises a locking stud at an end of said control portion.

9. The device of claim 8 including a slot in said lock case in which a portion of said latch is held when said latch is in said locked position.

10. The device of claim 9 wherein said locking stud includes a free edge locking said latch in said locked position.

11. The device of claim 1 including means for biasing said latch in said unlocked position.

12. The device of claim 8 wherein said locking stud is rotatable between a locked position and an unlocked position, said locked position being defined by cooperating stops on said case and said locking stud, said locking stud including a camming surface engaging said latch for moving said latch to said locked position, and means for biasing said locking stud in said locked position.

13. The device of claim 12 including means for biasing said latch in said unlocked position.

14. The device of claim 13 wherein said means for biasing said locking stud and said means for biasing said latch are together comprised by a single coil spring wound around said locking lever pivot shaft and having ends respectively engaged with said locking lever and said latch.

* * * * *